US005286264A

United States Patent [19]

Russo et al.

[11] Patent Number: 5,286,264

[45] Date of Patent: Feb. 15, 1994

[54] GASOLINE DETERGENT ADDITIVE COMPOSITION AND MOTOR FUEL COMPOSITION

[75] Inventors: Joseph M. Russo, Poughkeepsie; Sheldon Herbstman, New City; Jefrey B. Furman, Middletown, all of N.Y.

[73] Assignee: Texaco Inc., White Plains, N.Y.

[21] Appl. No.: 993,796

[22] Filed: Dec. 21, 1992

[51] Int. Cl.[5] ..... C10L 1/22

[52] U.S. Cl. ..... 44/347; 44/418; 44/419; 44/459; 564/193; 564/194; 564/196

[58] Field of Search ..... 44/418, 419, 347; 564/193, 194, 196

[56] References Cited

U.S. PATENT DOCUMENTS

| | | | |
|---|---|---|---|
| 3,510,282 | 5/1970 | Steffens | 44/419 |
| 4,060,553 | 11/1977 | Redmore et al. | 564/193 |
| 4,146,556 | 3/1979 | Redmore et al. | 564/193 |
| 4,427,562 | 1/1984 | Horodysky et al. | 44/418 |
| 4,518,782 | 5/1985 | Sung et al. | 44/419 |
| 4,568,358 | 2/1986 | Courtney | 44/419 |
| 5,114,435 | 5/1992 | Abramo et al. | 44/459 |

*Primary Examiner*—Ellen M. McAvoy
*Attorney, Agent, or Firm*—James J. O'Loughlin; Christopher Nicastri

[57] ABSTRACT

A gasoline detergent additive composition comprising a) the reaction product of a 4-alkyl-2-morpholinone and an alkylphenoxypolyoxyalkylene amine; b) the reaction product of a polyalkenyl succinic acid anhydride and a polyethylene polyamine; and c) a polyalphaolefin. A motor fuel composition is also provided.

30 Claims, No Drawings

GASOLINE DETERGENT ADDITIVE COMPOSITION AND MOTOR FUEL COMPOSITION

BACKGROUND OF THE INVENTION

1. Field of the Invention

This invention relates to an additive composition for use in motor fuels. More specifically, this invention relates to a motor fuel additive composition which is effective to reduce deposits on the intake valves of an internal combustion engine.

2. Description of Related Information

The combustion of a hydrocarbon motor fuel in an internal combustion engine leads to the formation and accumulation of deposits on intake valves. Intake valve deposits interfere with valve closing and eventually will lead to valve burning. Such deposits interfere with valve motion and valve seating, reduce the volumetric efficiency of the engine and reduce the maximum power obtainable. Valve deposits may be produced from, among other things, thermally and oxidatively unstable fuel or from lubricating oil oxidation products. The hard carbonaceous deposits produced collect in the tubes and runners that are part of the exhaust gas recirculation (EGR) flow. These deposits are believed to be formed from exhaust particles which are subjected to rapid cooling while mixing with the air-fuel mixture. Reduced EGR flow can result in engine knock and in nitric oxide, $NO_x$, emission increases. It would, therefore, be desirable to provide a motor fuel composition which minimizes or overcomes the formation of intake valve deposits.

Another problem common to internal combustion engines is the formation and accumulation of deposits on various parts of the combustion chamber as well as on the fuel intake and exhaust system of the engine. The presence of deposits in the combustion chamber seriously reduces the operating efficiency of the engine. First, deposit accumulation within the combustion chamber inhibits heat transfer between the chamber and the engine cooling system. This leads to higher temperatures within the combustion chamber, resulting in increases in the end gas temperature of the incoming charge. Consequently, end gas auto-ignition occurs, causing engine knock. In addition, the accumulation of deposits within the combustion chamber reduces the volume of the combustion zone, causing a higher than design compression ratio in the engine. This, in turn, can also lead to engine knocking. A knocking engine does not effectively utilize the energy of combustion. Moreover, a prolonged period of engine knocking can cause stress fatigue and wear in pistons, connecting rods, bearings and cam rods of the engine. The phenomenon noted is characteristic of gasoline powered internal combustion engines. It may be overcome by powering the engine with a higher octane gasoline which resists knocking. This need for a higher octane gasoline as the engine accumulates operating time has become known as the engine octane requirement increase (ORI) phenomenon. It is particularly advantageous if a fuel additive's contribution to engine ORI can be substantially reduced or eliminated by preventing or modifying deposit formation in the combustion chambers of the engine.

The present invention provides a gasoline detergent additive composition which reduces the level of deposits on intake valves with no significant contribution to combustion chamber deposits.

SUMMARY OF THE INVENTION

The present invention provides a detergent additive composition comprising a) a first component comprising the reaction product of:

i. a 4-alkyl-2-morpholinone represented by the formula:

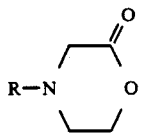

in which R represents a monovalent aliphatic radical having from 1 to 10 carbon atoms, and ii. an alkylphenoxypolyoxyalkylene amine represented by the formula:

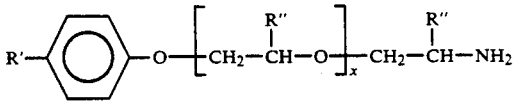

in which R′ represents a hydrocarbyl radical having from 4 to 30 carbon atoms, x has a value from 5 to 50, and R″ represents a methyl radical or a mixture of hydrogen and methyl radicals;

b) a second component comprising the reaction product of i. a polyalkenyl succinic acid anhydride represented by the formula

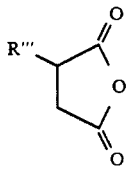

where R‴ is a polyalkenyl radical with a weight average molecular weight of about 300 to about 4000; and ii. a polyethylene polyamine represented by the formula $$H_2N\text{-}(CH_2-CH_2-NH)_n-CH_2-CH_2-NH_2$$

where n is a number between 0 and about 6; and c) a third component comprising a polyalphaolefin.

In a preferred embodiment, the detergent additive composition consists essentially of the three components.

In another embodiment, the present invention provides a motor fuel composition comprising a major portion of a hydrocarbon fuel boiling in the range between 90° F. and 450° F. and a minor portion, sufficient to reduce the formation of deposits on intake valves, of the additive composition described herein.

DETAILED DESCRIPTION OF THE INVENTION

Applicants have discovered a class of detergent additive compositions which are effective to reduce intake valve deposits without adding significantly to the formation of combustion chamber deposits. The detergent additive of the present invention comprises a mixture of three components.

The first component of the additive of the present invention is the reaction product of a 4-alkyl-2-morpholinone and an alkylphenoxypolyoxyalkylene amine.

The 4-alkyl-2-morpholinone used to prepare the additive of the present invention can be represented by the formula:

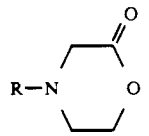

in which R represents a monovalent aliphatic radical having from 1 to about 10 carbon atoms. Preferably, R is an alkyl radical having from 1 to 4 carbon atoms and more preferably having from 1 to 3 carbon atoms. In a particularly preferred embodiment, R is a methyl radical. Specific compounds which fall within the scope of this formula include 4-methyl-2-morpholinone, 4-ethyl-2-morpholinone and 4-isopropyl-2-morpholinone. Of these compounds, 4-methyl-2-morpholinone is particularly preferred. These are known compounds which can be made by any suitable means. See, e.g., U.S. Pat. No. 3,073,822.

The alkylphenoxypolyoxyalkylene amine reactant can be represented by the formula:

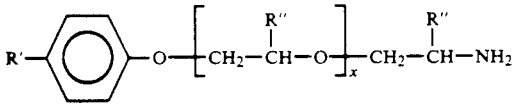

in which R' is a hydrocarbyl radical having from about 4 to about 30 carbon atoms, x represents a number from about 4 to about 50, and R'' represents a methyl radical or a mixture of hydrogen and methyl radicals. Preferably, R' represents a monovalent aliphatic radical having from about 6 to about 24 carbon atoms, and more preferably an aliphatic radical having from about 8 to about 20 carbon atoms. In a particularly preferred embodiment, R' is an aliphatic radical having from about 9 to about 12 carbon atoms. Typically, R' is an aliphatic radical having about 9 to about 12 carbon atoms. Preferably, x is a number from about 6 to about 30, and, most preferably, x is a number from about 10 to about 20.

As indicated above, the alkylphenoxypolyoxyalkylene amine reactant contains an internal radical represented by the formula:

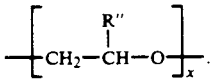

Preferably R'' is a methyl group, such that the internal radical is a propylene oxide radical. However, R'' can be a mixture of hydrogen and methyl radicals such that the internal radical will comprise a mixture of propylene oxide and ethylene oxide radicals. The mixture of propylene oxide and ethylene oxide radicals can form either a random or block copolymer. When the internal radical represents both propylene oxide and ethylene oxide radicals, the ratio of propylene oxide to ethylene oxide radicals employed may range from about 2:3 to about 999:1. Preferably the range of molar ratios of propylene oxide to ethylene oxide is from about 7:3 to 999:1.

In general, the alkylphenoxypolyoxyalkylene amine reactant of the present invention can be synthesized by reacting one mole of alkyl phenol with x moles of propylene oxide, ethylene oxide, or a mixture of propylene oxide and ethylene oxide, where x is defined as above, in the presence of a potassium or sodium hydroxide initiator under a nitrogen atmosphere.

The reaction is conducted at a temperature of about 90° C. to about 130° C., preferably about 110° C., at a pressure of about 0 to about 100 psig, preferably about 50 psig. The reaction will be substantially complete when the pressure stops dropping and becomes constant. The product is a alkylphenoxypolyoxyalkylene alcohol.

The alkylphenoxypolyoxyalkylene alcohol is then reductively aminated in the presence of ammonia and a catalyst. Suitably, from about 10 to about 200 moles of ammonia per mole of alkylphenoxypolyoxyalkylene alcohol are employed, and preferably, about 20 to about 100 moles of ammonia are employed per mole of alkylphenoxypolyoxyalkylene alcohol. The reaction is also preferably conducted in the presence of added hydrogen. The amount of added hydrogen used may be about 0.1 to about 10 moles per mole of alkylphenoxypolyoxyalkylene alcohol.

The nickel catalyst useful for reductively aminating the alkylphenoxypolyoxyalkylene alcohol is comprised of from about 70 to about 75 wt. % of nickel, about 20 to about 25 wt. % of copper, about 0.5 to about 5 wt. % of chromium and about 1 to about 5 wt. % of molybdenum. An especially preferred catalyst useful for producing the nonylphenoxypolyoxypropylene amine reactant useful in the present invention contains 70 to about 78 wt. % of nickel, about 20 to about 25 wt. % of copper, about 0.5 to about 3 wt. % of chromium, and about 1 to about 3 wt. % of molybdenum.

The reductive amination is preferably conducted at a pressure of about 100 to about 10,000 psig, preferably about 100 to about 3,000 psig, and at a temperature of about 150° C. to about 240° C.

The reductive amination of alkylphenoxypolyoxyalkylene alcohol may be conducted batch-wise using an autoclave containing powdered catalyst, in which case the residence time is suitably from about 0.5 to about 5 hours.

More preferably, the reductive amination is conducted on a continuous basis using a bed of pelleted catalyst though which the hydrogen, ammonia and alkylphenoxypolyoxyalkylene alcohol are passed. When the reaction is conducted on a continuous basis, the alkylphenoxypolyoxyalkylene alcohol is suitably charged to the catalyst bed at the rate of about 0.1 to about 1.5 grams per cubic centimeter of catalyst per hour and, more preferably, about 0.2 to about 0.8 grams per cubic centimeter of catalyst per hour. The product of the reductive amination of alkylphenoxypolyoxyalkylene alcohol is the alkylphenoxypolyoxyalkylene amine reactant of the present invention.

The 4-alkyl-2-morpholinone reactant and the alkylphenoxypolyoxyalkylene amine reactant are reacted in about a 1:1 mole ratio. While other mole ratios are contemplated, no significant advantage is realized in departing from about equimolar reaction ratios. The reactants can be reacted with stirring at temperatures between about 30° C. and about 130° C., and reaction times will depend upon reaction temperature. For example, at 130° C., the reaction will take between 1 and 4 hours, while at 30° C., the reaction will take between 1 and 30 hours. Preferably, the reaction is conducted at about 130° C.

The first component of the additive composition of the present invention can be represented by the formula:

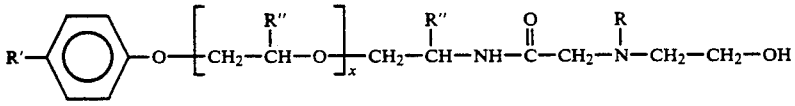

where R, R', R'' and x are defined as they are in the description of the reactants above.

The second component of the additive of the present invention is the reaction product of a polyalkenyl succinic acid anhydride and a polyethylene polyamine.

The polyalkenyl succinic acid anhydride can be represented by the formula:

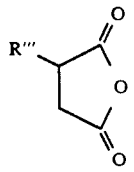

where R''' is a polyalkenyl radical with a weight average molecular weight of about 300 to about 4000.

Preferably, the polyalkenyl radical, R''', has a molecular weight of about 1000 to about 2500, and, more preferably, a molecular weight of about 1200 to about 1500. Typical olefins which can be polymerized to produce the alkenyl radical include ethylene, propylene, butylene, amylene, etc.

In a preferred embodiment, R is a polyisobutenyl radical, and the polyalkenyl succinic acid anhydride is polyisobutenyl succinic acid anhydride. Polyisobutenyl succinic acid anhydride is most preferably formed by reacting maleic anhydride and a polybutene, such as a polyisobutene commercially available from Amoco Chemical Company under the INDOPOL TM series trade name. The most preferred polybutene reactant is commercially available as INDOPOL TM H-300 (wt. avg. m.w. ≈ 1290). Polyalkenyl succinic anhydrides are known compounds whose preparation is old to the art. Methods of synthesizing the above described polyisobutenyl succinic acid anhydride reactant are disclosed by, inter alia, co-owned U.S. Pat. Nos. 4,496,746 (Powell), 4,431,825 (Powell), 4,414,397 (Powell), and 4,325,876 (Chafetz).

The polyethylenepolyamine reactant can be represented by the formula:

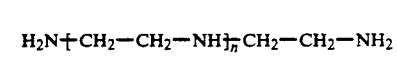

where n is a number between 0 and about 6. Preferably, n is a number between about 2 and about 4, and, most preferably, n is 3.

The following are typical polyethylenepolyamines which, when reacted with a polyalkenyl succinic acid anhydride, provide the additives described by the above formulas: ethylene diamine; diethylene triamine; triethylene tetramine; tetraethylenepentamine; pentaethylenehexamine; and hexaethyleneheptamine. These polyethylenepolyamines are known compounds which are commercially available from the Texaco Chemical Company.

As described above, the second component of the detergent additives of the present invention is the reaction product of a polyalkenyl succinic acid anhydride, e.g., polyisobutenyl succinic acid anhydride, with a polyethylenepolyamine. This reaction can be carried out by mixing the reactants with stirring in a vessel under a nitrogen atmosphere, at a temperature ranging from about 50° F. to about 450° F. Overhead by-products are removed at reduced pressure, and the succinimide product is collected.

The succinimide synthesis reaction will produce a mixture of both monosuccinimides and bis-succinimides, represented by the formulas I and II respectively, where R''' is defined as above.

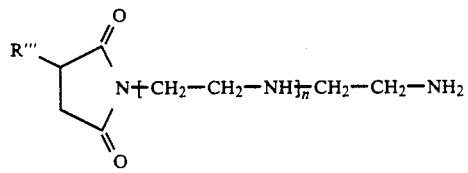

(I)

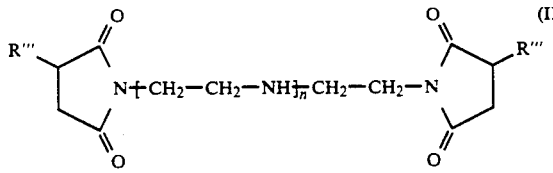

(II)

While the bis-succinimide is preferred for use in the additive composition of the present invention, mixtures of mono- and bis-succinimides ranging from virtually 100% mono-succinimide to virtually 100% bis-succinimide are useful. Those skilled in the art will understand that the reaction can be driven toward producing more bis- and less mono-succinimide, or vice versa, by changing the ratio of the reactants. Preferably, the ratio of polyalkenyl succinic acid anhydride reactant to polyethylenepolyamine reactant is greater than about 2:1.

The polyalkenyl succinimide is advantageously mixed with an aromatic solvent to improve handling.

The third component of the additive composition of the present invention is a polyalphaolefin. The polyalphaolefins useful in the present invention are those with weight average molecular weights up to about 10,000. Polyalphaolefins are known compounds whose syntheses are old in the art. Polyalphaolefins useful in the additive composition of the present invention are the available from Ethyl Chemical Company, e.g., under the trade names Ethyl Flo TM 162 and Ethyl Flo TM 180. Ethyl Flo TM 162 is a hydrogenated dimer of decene with a viscosity of 2 centistokes at 100° C. and Ethyl Flo TM 180 is a high molecular weight polydecene having a viscosity of 100 centistokes at 100° C.

EXAMPLES

The following Examples I–V are provided to illustrate the preparation of the first component of the additive composition of the present invention.

EXAMPLE I

A. Preparation of Propylene Oxide Adduct of Nonyl Phenol

Fifteen pounds of nonyl phenol and 226.8 grams of 45 percent aqueous potassium hydroxide were charged into a 10-gallon kettle. The reactor was then purged with pre-purified nitrogen. The reactor was heated to 100° C., while maintaining a nitrogen purge, and the initiator sodium hydroxide was dried to a water content of less than 0.15 percent using both vacuum and nitrogen stripping. 13.5 moles of propylene oxide (53.4 pounds) was then reacted at 110°–115° C. at 60 psig over an 8.5 hour period. The reaction mixture was then digested for two hours to an equilibrium pressure and purged with nitrogen for 15 minutes. The alkaline product was then neutralized at 95° C. by stirring for two hours with 612 grams Magnesol 30/40 TM adsorbent which was added in an aqueous slurry. Di-t-butyl p-cresol (9.3 grams) was then added to stabilize the product against oxidation. The neutralized product was then vacuum stripped to a minimum pressure at 110° C., nitrogen stripped, and filtered. Properties of the finished product are given in Table I below.

TABLE I

| Properties | |
|---|---|
| Acid no., mg KOH/g | 0.001 |
| Hydroxyl no. mg KOH/g | 59.2 |
| Unsaturation, meg/g | 0.036 |
| Water, wt. % | 0.04 |
| pH in 10:6 isopropanol-water | 8.3 |
| Color, Pt-Co | 50 |
| Sodium, ppm | 0.5 |
| Potassium, ppm | 3.5 |
| Viscosity, 77° F., μ | 123 |

B. Preparation of Nonylphenoxypolyoxypropylene Amine 1.0 pound per hour of the product of Example 1A, 1.0 pound per hour of ammonia and 50 liters per hour of hydrogen were added to a tubular reactor filled with 1250 milliliters of a nickel catalyst. The reactor conditions were 2000 psig and 210° C. The crude reactor effluent was charged into a clean dry kettle, then nitrogen stripped to 75° C. and then placed under a vacuum and heated to 100° C. The product had the following analysis:

| | meq/gram |
|---|---|
| Total acetylatables | 1.09 |
| Total amine | 1.05 |
| Primary amine | 1.05 |

C. Preparation of the Reaction Product of 4-Methyl-2-Morpholinone and Nonylphenoxypolyoxypropylene Amine The following were charged into a 2-liter, three-necked flask equipped with a thermometer, stirrer, and nitrogen outlet: 1099.8 grams of nonylphenoxypolyoxypropylene amine (the product of Example 1B) and 132.8 grams of 4-methyl-2-morpholinone. The mixture was heated to 130° C. for two hours. The resulting product had the following analysis:

| | meq/gram |
|---|---|
| Total acetylatables | 1.09 |
| Total amine | 1.002 |

and can be represented by the formula:

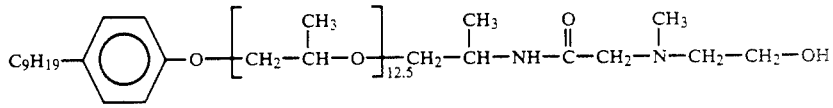

EXAMPLE II

Example I was repeated, except that 7.5 moles of propylene oxide, instead of 13.5 moles, were reacted with nonylphenol in making Preparation A.

EXAMPLE III

Example I was repeated, except that 19.5 moles of propylene oxide, instead of 13.5 moles, were reacted with nonylphenol in making Preparation A.

EXAMPLE IV

Example I was repeated, except that the morpholinone reacted was 4-isopropyl-2-morpholinone instead of the 4-methyl analog.

EXAMPLE V

Example I was repeated, except that 13.8 moles of a mixture of ethylene oxide and propylene oxide, instead of 13.5 moles of propylene oxide, were reacted with nonylphenol in making Preparation A.

Examples VI and VII are provided to illustrate the preparation of the second component of the additive of the present invention.

EXAMPLE VI

Equimolar amounts of polyisobutenyl succinic acid anhydride (avg. mol. wt. 1389) is mixed with stirring in a reaction vessel with tetraethylenepentamine (TEPA) under a nitrogen atmosphere at 100° F. The temperature is raised to 350° F. and stirring is continued for 2 hours. Pressure in the vessel is then reduced for a period of one hour to remove water produced by the reaction. The product is a mixture of the mono- and the bis-succinimide of TEPA which comprises mostly the mono-succinimide.

EXAMPLE VII

The process of Example 1 is repeated with twice the amount of TEPA. The product is a mixture of the mono- and the bis-succinimide of TEPA which comprises mostly the bis-succinimide.

The motor fuel composition of the present invention comprises a major portion of a hydrocarbon fuel boiling in the gasoline range between 90° F. and about 450° F., and a minor portion of the additive combination described above, sufficient to reduce the formation of deposits on port fuel injectors and intake valves.

Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chain or branched chain paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline. Thus, the fuel composition can contain anti-knock compounds such as tetraethyl lead compounds, anti-icing additives, and the like.

The fuel composition of the present invention comprises about 25 to about 200 PTB of the reaction product of the 4-alkyl-2-morpholinone and the alkylphenoxypolyoxyalkylene amine, preferably about 50 to about 150 PTB, and more preferably about 75 to about 125 PTB; about 15 to about 130 PTB of the succinimide component, preferably about 30 to about 100 PTB, and more preferably about 45 to about 80 PTB; and about 50 to about 400 PTB of the polyalphaolefin component, preferably about 100 to about 300 PTB and more preferably about 150 to about 250 PTB.

The additive composition of the present invention can be formulated apart from a fuel composition by mixing about 25 to about 200 parts by weight of the reaction product of the 4-alkyl-2-morpholinone and the alkylphenoxypolyoxyalkylene amine, preferably about 50 to about 150 parts by weight, and more preferably about 75 to about 125 parts by weight, with about 15 to about 130 parts by weight of the succinimide component, preferably about 30 to about 100 parts by weight, and more preferably about 45 to about 80 parts by weight, and about 50 to about 400 parts by weight of the polyalphaolefin component, preferably about 100 to about 300 parts by weight and more preferably about 150 to about 250 parts by weight.

The additive composition of the present invention is effective in very small concentrations and, therefore, for consumer end use it is desirable to package it in dilute form. Thus, a concentrate of the additive composition of the present invention can be provided comprising a diluent e.g., xylene and about 1 to about 50 wt. % of the additive.

Intake Valve Clean Keep Clean Test

A test was developed to determine the intake valve detergency of an additive as well as to determine whether the additive will cause the intake valves to stick.

In small four-cylinder gasoline powered engines, the intake valves accumulate large amounts of deposits which interfere with the operation of the engine. A good detergent/dispersant is required to prevent the buildup of these deposits. The Honda Generator test was developed to measure the activity of additives in preventing the buildup of intake valve deposits (IVD) (keep clean). The measurements are done in two ways: (1) the intake valves at the end of the run are rated using the CRC method of rating (a valve with a rating of 10 is perfectly clean, and a valve rating of 6 or less denotes heavy deposit levels); and (2) intake valve deposit weights are obtained and also reported in grams.

The Honda Generator Test employs a Honda ES6500 generator with the following specifications:

TABLE II

| Honda ES6500 Generator | |
|---|---|
| Type: | 4-stroke, overhead cam, 2-cylinder |
| Cooling system: | Liquid-cooled |
| Displacement: | 369 cubic cm. (21.9 cu. in) |
| Bore × stroke: | 56 × 68 mm (2.3 × 2.7 in) |
| Maximum Horsepower: | 12.2 HP/3600 rpm |
| Maximum Torque: | 240 kg-cm (17.3 ft-lb)/3000 rpm |

Each generator is equipped with an auto-throttle controller to maintain the rated speed when load is applied. Load is applied to each generator by plugging in a water heater. Various loads are simulated by changing the size of the water heaters connected to the generator.

The procedure for the Honda Generator Test can be described as follows. The test is started with a new or clean engine (clean valve, manifold, cylinder head, combustion chamber) and a new charge of lubricant. The generator is operated for 80 hours on the fuel to be tested following the test cycle of 2 hours at 1500 Watt load and 2 hours at 2500 Watt load, both at 3600 r.p.m. The engine is thereafter disassembled and the cylinder head stored, with valve spring and seal removed, in a freezer at 0° F. for 12–24 hours. The intake valves are disturbed as little as possible.

IV Lbs Push Test

The amount of force in pounds to push open the valve is determined upon removal from the freezer.

CRC Test

The intake valves (IV), piston crown (PC) and combustion chamber (CC) are rated visually according to standard Coordinating Research Council (CRC) procedures (scale from 1–10: 1=dirty; 10=clean).

The additive of the present invention, where the first component comprised the product of Example I, and the second component was the reaction product of polyisobutenyl succinic acid anhydride (wt. avg. mol. wt. ≈ 1389) and tetraethylene pentamine was tested pursuant to the preceding test description for its effectiveness in keeping intake valves clean. Two additive compositions of the present invention, differing only in the polyalphaolefin component, were compared to an unadditized base fuel and to an additive comprising solely the first component of the additive of the present invention, i.e., the product of Example I. The following additive compositions were tested:

TABLE III

| Run | Additive Composition |
|---|---|
| 1 | unadditized fuel |
| 2 | 100 PTB of the reaction product of Example I |
| 3 | 50 PTB of the reaction product of Example I; 65 PTB of the polyisobutenyl succinimide of tetraethylene pentamine with a wt. avg. mol. wt. of about 1560; and 100 PTB of Ethyl Flo 162 |
| 4 | 50 PTB of the reaction product of Example I; 65 PTB of the polyisobutenyl succinimide of tetraethylene pentamine with a wt. avg. mole. wt. of about 1560; and 100 PTB of Ethyl Flo 180 |

The Honda Generator intake valve keep clean test results are set forth in Table IV:

TABLE IV

| | Combustion Chamber Deposits | | Intake Valve Rating | | |
|---|---|---|---|---|---|
| Run | CRC PC | CRC CC | CRC IV | Wt. (mg) | lbs push |
| 1 | 8.36 | 8.25 | 8.6 | 127 | 0.2 |
| 2 | 8.27 | 8.3 | 9.7 | 9.0 | 0.5 |
| 3 | 8.07 | 7.82 | 9.9 | 2.8 | 0.4 |
| 4 | 7.79 | 8.0 | 9.9 | 1.1 | 0.6 |

These test results illustrate that the additives of the present invention exhibit superior intake valve "keep clean" detergent activity. Furthermore, the additives of the present invention exhibit intake valve "keep clean" detergent activity which is improved over an additive comprising solely 100 PTB of the first component of the additive of the present invention, which first component is a very effective detergent in its own right. The additives of the present invention are less expensive to produce than an additive comprising solely the first component of the present invention, because they can be formulated with a lesser amount of the expensive first component and exhibit greater intake valve deposit detergent activity.

Motor fuel and concentrate compositions of the instant invention may additionally comprise any of the additives generally employed in motor fuel compositions. Thus, compositions of the instant invention may additionally contain conventional anti-knock compounds, such as tetraethyl lead compounds, anti-icing additives, upper cylinder lubricating oils, and the like.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

We claim:

1. A detergent additive composition comprising a) a first component comprising the reaction product of:

i. a 4-alkyl-2-morpholinone represented by the formula:

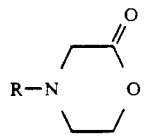

in which R represents a monovalent aliphatic radical having from 1 to 10 carbon atoms, and ii. an alkylphenoxypolyoxyalkylene amine represented by the formula:

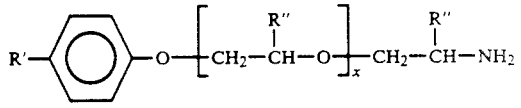

in which R' represents a hydrocarbyl radical having from 4 to 30 carbon atoms, x has a value from 5 to 50, and R'' represents a methyl radical or a mixture of hydrogen and methyl radicals;

b) a second component comprising the reaction product of i. a polyalkenyl succinic acid anhydride represented by the formula

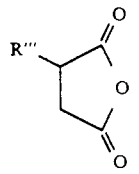

where R''' is a polyalkenyl radical with an weight average molecular weight of about 300 to about 4000; and ii. a polyethylene polyamine represented by the formula $$H_2N\text{-}(CH_2-CH_2-NH)_n-CH_2-CH_2-NH_2$$

where n is a number between 0 and about 6; and c) a third component comprising a polyalphaolefin.

2. The detergent additive composition of claim 1 in which R represents a monovalent aliphatic radical having from 1 to 3 carbon atoms.

3. The detergent additive composition of claim 1 in which R' represents a monovalent aliphatic radical having from 6 to 24 carbon atoms.

4. The detergent additive composition of claim 1 in which x has a value from about 6 to 20.

5. The detergent additive composition of claim 1 in which R'' represents a mixture of methyl radicals and hydrogen such that the internal alkylene oxide radical of the alkylphenoxypolyoxyalkylene amine, represented by

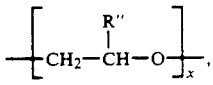

comprises a mixture of propylene oxide and ethylene oxide in a molar ratio of about 2:3 to about 999:1 propylene oxide:ethylene oxide.

6. The detergent additive composition of claim 5 in which the molar ratio of propylene oxide to ethylene oxide is about 7:3 to about 999:1.

7. The detergent additive composition of claim 1 wherein R''' has a weight average molecular weight of about 1000 to about 2500.

8. The detergent additive composition of claim 1 wherein n is a number between about 2 to about 4.

9. The detergent additive composition of claim 1 wherein the polyalphaolefin has a weight average molecular weight of up to about 10,000.

10. The detergent additive composition of claim 1 wherein the polyalphaolefin is a polydecene.

11. The detergent additive composition of claim 1 wherein the polyalphaolefin is a hydrogenated dimer of decene.

12. The detergent additive composition of claim 1 comprising about 25 to about 200 parts by weight of the first component, about 15 to about 130 parts by weight of the second component, and about 50 to about 400 parts by weight of the third component.

13. The detergent additive composition of claim 1 comprising about 50 to about 150 parts by weight of the first component, about 30 to about 100 parts by weight of the second component, and about 100 to about 300 parts by weight of the third component.

14. The detergent additive composition of claim 1 comprising about 75 to about 125 parts by weight of the first component, about 45 to about 80 parts by weight of the second component, and about 150 to about 250 parts by weight of the third component.

15. The detergent additive composition of claim 1 in which R represents a methyl radical, R' represents a monovalent aliphatic radical having from 8 to 20 carbon atoms, R'' represents a methyl radical, x has a value of from about 10 to about 20, R''' has a weight average molecular weight of about 1200 to about 1500 and n is about 3.

16. A motor fuel composition comprising a major portion of a hydrocarbon fuel boiling in the range between 90° F. and 450° F.; and a minor portion, sufficient to reduce the formation of deposits on intake valves, of an additive composition which comprises a) a first component comprising the reaction product of:

i. a 4-alkyl-2-morpholinone represented by the formula:

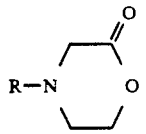

in which R represents a monovalent aliphatic radical having from 1 to 10 carbon atoms, and ii. an alkylphenoxypolyoxyalkylene amine represented by the formula:

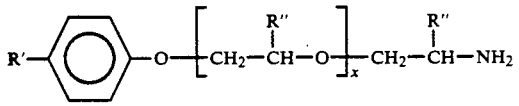

in which R' represents a hydrocarbyl radical having from 4 to 30 carbon atoms, x has a value from 5 to 50, and R'' represents a methyl radical or a mixture of hydrogen and methyl radicals;

b) a second component comprising the reaction product of i. a polyalkenyl succinic acid anhydride represented by the formula

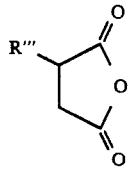

where R''' is a polyalkenyl radical with a weight average molecular weight of about 300 to about 4000; and ii. a polyethylene polyamine represented by the formula $$H_2N\text{-}(CH_2-CH_2-NH)_n-CH_2-CH_2-NH_2$$

where n is a number between 0 and about 6; and c) a third component comprising a polyalphaolefin.

17. The fuel composition of claim 16 in which R represents a monovalent aliphatic radical having from 1 to 3 carbon atoms.

18. The fuel composition of claim 16 in which R' represents a monovalent aliphatic radical having from 6 to 24 carbon atoms.

19. The fuel composition of claim 16 in which x has a value from about 6 to 20.

20. The fuel composition of claim 16 in which R'' represents a mixture of methyl radicals and hydrogen such that the internal alkylene oxide radical of the alkylphenoxypolyoxyalkylene amine, represented by

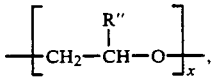

comprises a mixture of propylene oxide and ethylene oxide in a molar ratio of about 2:3 to about 999:1 propylene oxide:ethylene oxide.

21. The fuel composition of claim 20 in which the molar ratio of propylene oxide to ethylene oxide is about 7:3 to about 999:1.

22. The fuel composition of claim 16 wherein R''' has a weight average molecular weight of about 1000 to about 2500.

23. The fuel composition of claim 16 wherein n is a number between about 2 and about 4.

24. The fuel composition of claim 16 wherein the polyalphaolefin has a weight average molecular weight of up to about 10,000.

25. The fuel composition of claim 16 wherein the polyalphaolefin is a polydecene.

26. The fuel composition of claim 16 wherein the polyalphaolefin is a hydrogenated dimer of decene.

27. The fuel composition of claim 16 in which R represents a methyl radical, R' represents a monovalent aliphatic radical having from 8 to 20 carbon atoms, R'' represents a methyl radical, x has a value of from about 10 to about 20, R''' has a weight average molecular weight of about 1200 to about 1500 and n is about 3.

28. The fuel composition of claim 16 comprising about 25 to about 200 PTB of the first component, about 15 to about 130 PTB of the second component, and about 50 to about 400 PTB of the third component.

29. The fuel composition of claim 16 comprising about 50 to about 150 PTB of the first component, about 30 to about 100 PTB of the second component, and about 100 to about 300 PTB of the third component.

30. The fuel composition of claim 16 comprising about 75 to about 125 PTB of the first component, about 45 to about 80 PTB of the second component, and about 150 to about 250 PTB of the third component.

* * * * *